US011455964B2

(12) United States Patent
Qiu

(10) Patent No.: US 11,455,964 B2
(45) Date of Patent: Sep. 27, 2022

(54) DRIVING METHOD FOR DISPLAY PANEL DISPLAYING ACCORDING TO THE ADJUSTED DISPLAY AREA, DRIVING CIRCUIT, AND DISPLAY DEVICE

(71) Applicant: HKC CORPORATION LIMITED, Shenzhen (CN)

(72) Inventor: Bin Qiu, Chongqing (CN)

(73) Assignee: HKC CORPORATION LIMITED, Shenzhen (CN)

( * ) Notice: Subject to any disclaimer, the term of this patent is extended or adjusted under 35 U.S.C. 154(b) by 31 days.

(21) Appl. No.: 17/040,963

(22) PCT Filed: Dec. 13, 2018

(86) PCT No.: PCT/CN2018/120840

§ 371 (c)(1),
(2) Date: Sep. 23, 2020

(87) PCT Pub. No.: WO2020/113648

PCT Pub. Date: Jun. 11, 2020

(65) Prior Publication Data

US 2021/0366418 A1 Nov. 25, 2021

(30) Foreign Application Priority Data

Dec. 4, 2018 (CN) ..... 201811471243.8

(51) Int. Cl.
*G09G 3/30* (2006.01)
*G09G 3/36* (2006.01)

(52) U.S. Cl.
CPC ..... *G09G 3/36* (2013.01); *G09G 2340/0407* (2013.01); *G09G 2354/00* (2013.01)

(58) Field of Classification Search
CPC ..... G09G 5/227; G09G 5/391; G09G 2320/06–0613; G09G 3/005; G09G 2340/04–0492
See application file for complete search history.

(56) References Cited

U.S. PATENT DOCUMENTS

2001/0048418 A1* 12/2001 Kasai ..... G09G 3/3611 345/87
2006/0012616 A1* 1/2006 Paek ..... H04N 5/775 345/698

(Continued)

FOREIGN PATENT DOCUMENTS

CN 101783895 A 7/2010
CN 101815184 A 8/2010

(Continued)

OTHER PUBLICATIONS

Wenfei Li, the ISA written comments,Jul. 2019, CN.
Wenfei Li, the International Search Report,dated Jul. 2019, CN.

*Primary Examiner* — Sanghyuk Park

(57) ABSTRACT

This application discloses a driving method for a display panel, a driving circuit, and a display device. The driving method for a display panel includes steps of: obtaining resolution of source data; obtaining resolution of a current display panel; obtaining an adjusted display area corresponding to the source data; and displaying on the display panel according to the adjusted display area after a data operation is performed according to the resolution of the source data and the resolution of the current display panel.

16 Claims, 4 Drawing Sheets

(56) References Cited

U.S. PATENT DOCUMENTS

| | | | | |
|---|---|---|---|---|
| 2008/0226182 | A1* | 9/2008 | Ichieda | H04N 1/33392<br>382/232 |
| 2014/0204244 | A1* | 7/2014 | Choi | H04N 5/23222<br>348/231.99 |
| 2014/0298252 | A1* | 10/2014 | Choi | G06F 3/04886<br>715/788 |
| 2017/0249919 | A1* | 8/2017 | Bae | H04N 21/440263 |

FOREIGN PATENT DOCUMENTS

| | | | |
|---|---|---|---|
| CN | 103546715 | A | 1/2014 |
| CN | 104103243 | A | 10/2014 |
| CN | 104469178 | A | 3/2015 |
| CN | 105554549 | A | 5/2016 |
| CN | 106686453 | A | 5/2017 |
| WO | WO2015151279 | A | 10/2015 |

* cited by examiner

DRIVING METHOD FOR DISPLAY PANEL DISPLAYING ACCORDING TO THE ADJUSTED DISPLAY AREA, DRIVING CIRCUIT, AND DISPLAY DEVICE

CROSS REFERENCE OF RELATED APPLICATIONS

This application claims the priority to the Chinese Patent Application No. CN201811471243.8, filed with National Intellectual Property Administration, PRC on Dec. 4, 2018 and entitled "DRIVING METHOD FOR DISPLAY PANEL, DRIVING CIRCUIT, AND DISPLAY DEVICE", which is incorporated herein by reference in its entirety.

TECHNICAL HELD

This application relates to the field of display technologies, and in particular, to a driving method for display panel, a driving circuit, and a display device.

BACKGROUND

The statement here only provides background information related to this application, and does not necessarily constitute the existing technology.

With development and advancement of science and technologies, due to hot spots such as thinness, power saving, and low radiation, liquid crystal displays have become mainstream products of displays and are widely applied.

Ultra high definition (UHD) sources are limited, many movies still only have standard definition sources and high definition sources, for today's UHD TVs, if there is no UHD source, a display effect is greatly reduced. A larger size of the TV indicates a more unclear whole picture and more obvious rough details. Consequently, an optimal ornamental effect cannot be achieved and a waste of hardware facilities is caused.

SUMMARY

This application provides a driving method for a display panel, a driving circuit, and a display device, to resolve a problem of an unclear display picture in a UHD TV caused by a standard definition source.

This application provides a driving method, for a display panel, including steps of:

obtaining resolution of source data;

obtaining resolution of the current display panel;

obtaining, an adjusted display area corresponding to the source data; and displaying on the display panel according to the adjusted display area after a data operation is performed according to the resolution, of the source data and the resolution of the current display panel.

Optionally, in the step of obtaining an adjusted display area corresponding to the source data:

automatically calculating a size of an actual display area with a preset corresponding ratio according to the resolution of the source data and actual resolution of the display panel.

Optionally, in the step of obtaining an adjusted display area corresponding to the source data:

displaying, according to the resolution of the source data and actual resolution of the display panel, in a 1:1 manner corresponding to each pixel in the display panel to calculate a size of an actual display area.

Optionally, the step of the adjusted display area obtaining the adjusted display area the adjusted display area corresponding to the source data includes:

prompting a user to input adjustment data of an actual display area; and setting an adjusted actual display area according to the adjustment data of the actual display area input by the user.

Optionally, before the step of prompting a user to input adjustment data, the method further includes:

comparing the resolution of the source data and the resolution of the display panel; and when the resolution of the display panel is higher than the resolution of the source data, starting the step of prompting a user to input adjustment data.

Optionally, before the step of prompting a user to input adjustment data, the method further includes:

comparing the resolution f the source data and the resolution of the display panel; and when the resolution of the display panel is equal to or lower than the resolution of the source data, directly Skipping the step of prompting a user to input adjustment data, and using a whole area of the display panel as the actual display area to drive a MI-picture display of the display panel.

Optionally, in the step of obtaining an adjusted display area corresponding to the source data:

if the user selects no adjustment, using the whole area of the display panel as an actual display area to drive a full-picture display of the display panel.

Optionally, the adjustment data of the actual display area includes: obtaining target resolution of a source; and in the step of obtaining an adjusted display area corresponding to the source data, the corresponding adjusted display area is calculated and generated according to the target resolution of the input source.

Optionally, the step of displaying on the display panel according to the adjusted display area after a data operation is performed according to the resolution; of the source data and the resolution of the current display panel includes:

performing a data operation on the source data according to the target resolution of the source, calculating and generating a size of the display area, correspondingly generating picture data corresponding to each pixel in the actual display area of the display panel, driving the display panel, and displaying on the display panel.

Optionally, the adjustment data of the actual display area includes: a size of the actual display area; and in the step of obtaining an adjusted display area corresponding to the source data, the input size of the actual display area is directly set to an adjusted size of the actual display area.

Optionally, the step of displaying on the display panel according to the adjusted display area after a data operation is performed according to the resolution of the source data and the resolution of the current display panel includes:

performing a data operation on the source data according to a size of the display area, correspondingly generating picture data corresponding to each pixel in the actual display area of the display panel, driving the display panel, and displaying on the display panel.

Optionally, the adjustment data of the actual display area further includes: a location of the actual display area; and the step of displaying on the display panel according to the adjusted display area after a data operation is performed according to the resolution of the source data and the resolution of the current display panel includes:

correspondingly generating, with reference to the location of the actual display area, picture data corresponding to each pixel in the actual display area of the display panel, driving the display panel, and displaying on the display panel.

Optionally, the location of the actual display area is a center location of the display panel or an edge location of the display panel.

Optionally, an area outside the adjusted display area of the display panel is a display filling area; and in the step of displaying on the display panel according to the adjusted display area after a data operation is performed according to the resolution of the source data and the resolution of the current display panel, the source data is displayed in the adjusted display area; and a filling picture is displayed in the filling area.

Optionally, the filling picture is a black picture.

Optionally, the filling picture is a plain white picture.

Optionally, at least two actual display areas are arranged on the display panel, and the at least two display areas correspond to same or different source data.

This application further discloses a driving circuit, including: a source analysis chip, configured to obtain resolution of source data; a panel resolution analysis chip, obtaining configured to obtain resolution of a current display panel; an adjusted display area obtaining chip, configured to obtain an adjusted display area corresponding to the source data; and a calculation and display chip, configured to: perform a data operation according to the resolution of the source data and the resolution of the current display panel, generate actual driving data, and display on the display panel according to the adjusted display area.

This application further discloses a display device, including a display panel; and a driving circuit for driving the display panel.

Optionally, the display panel includes a thin film transistor-liquid crystal display (TFT-LCD) panel.

In this solution, when the display panel is driven, resolution of sources may be different for different source data received by the display panel, so that definition of pictures displayed by the display panel may be different. In this solution, a size and a location of a display area of the display panel are set for source data having different resolution, an operation is correspondingly adjusted according to the resolution of the source and the resolution of the display panel, and a display is performed in a wanted location of the display area and in a wanted size of the display area. Compared with the solution of displaying the source data directly the display panel according to original resolution, the size of the display area can be adjusted according to a user requirement, then actual resolution of same source data is adjusted accordingly, and during a display, a display effect which is better and closer to the user requirement can be achieved.

BRIEF DESCRIPTION OF DRAWINGS

The included accompanying drawings are used to provide further understanding of the embodiments of this application, constitute a part of the specification, and are used to illustrate implementations of this application and explain the principle of this application together with literal descriptions. Apparently, the accompanying drawings in the following descriptions are merely some embodiments of this application, and a person of ordinary skill in the art can also obtain other accompanying drawings according to these accompanying drawings without involving any creative effort. In the accompanying drawings.

DETAILED DESCRIPTION OF EMBODIMENTS

Figure 1:
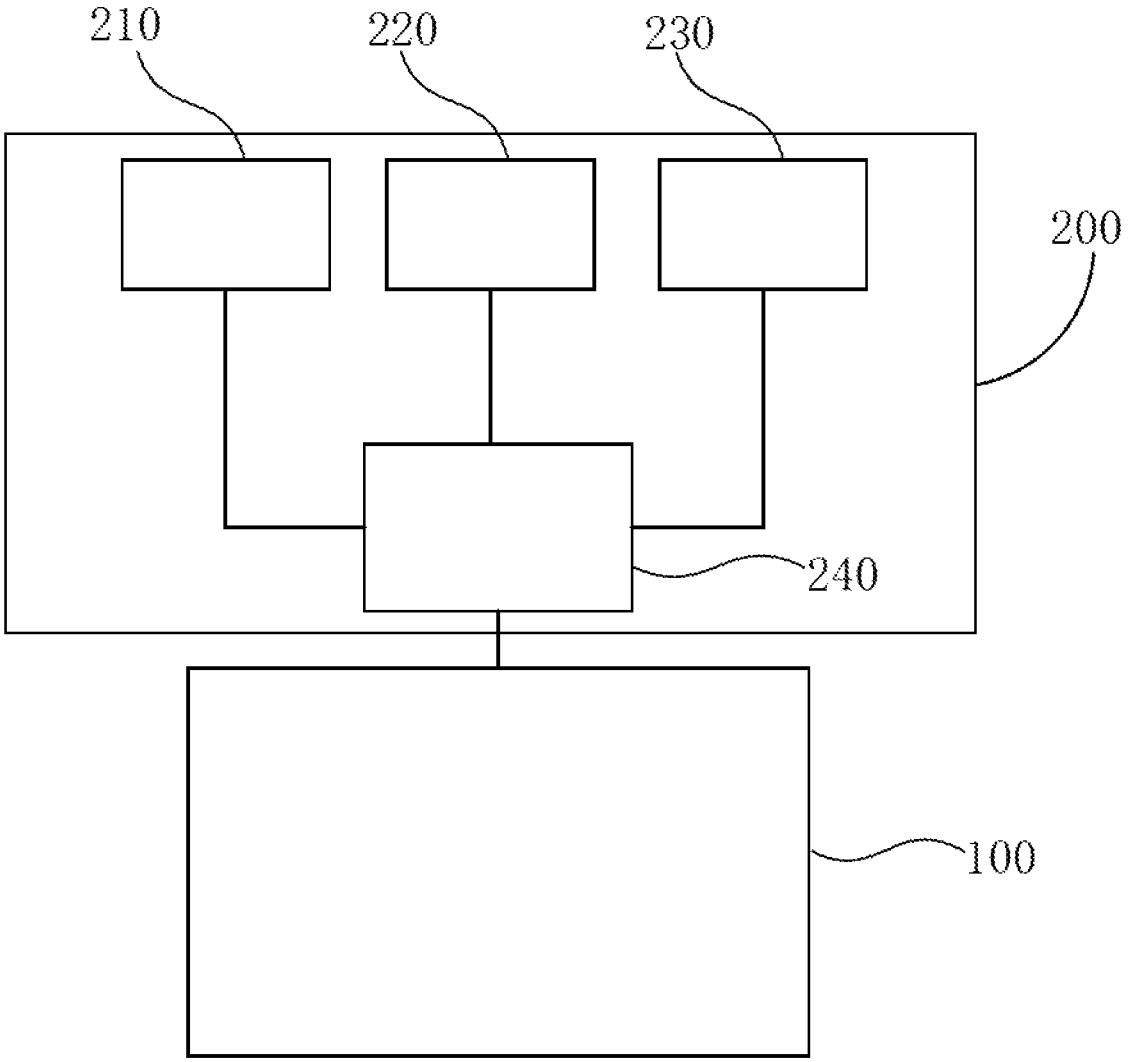
FIG. 1 is a schematic diagram of a driving circuit according to t embodiment of this application.

Specific structures and functional details disclosed herein are merely representative, and are intended to describe the objectives of the exemplary embodiments of this application. However, this application may be specifically implemented in many alternative forms, and should not be construed as being limited to the embodiments set forth herein.

In the description of this application, it should be understood that orientation or position relationships indicated by the terms such as "center", "transverse", "on", "below", "left", "right", "vertical", "horizontal", "top", "bottom", "inside", and "outside" are based on orientation or position relationships shown in the accompanying drawings, and are used only for ease and brevity of illustration and description, rather than indicating or implying that the mentioned apparatus or component must have a particular orientation or must be constructed and operated in a particular orientation. Therefore, such terms should not be construed as a limitation to this application. In addition, the terms such as "first" and "second" are used only for the purpose of description, and should not be understood as indicating or implying the relative importance or implicitly specifying the number of the indicated technical features. Therefore, a feature defined by "first" or "second" can explicitly or implicitly includes one or more of said features. In the description of this application, unless otherwise stated, "a plurality of" means two or more than two. In addition, the terms "include", "comprise" and any variant thereof are intended to cover non-exclusive inclusion.

In the description of this application, it should be noted that unless otherwise explicitly specified or defined, the tams such as "mount", "install", "connect", and "connection" should be understood in a broad sense. For example, the connection may be a fixed connection, a detachable connection, or an integral connection; or the connection may be a mechanical connection or an electrical connection; or the connection may be a direct connection, an indirect connection through an intermediary, or internal communication between two components. A person of ordinary skill in the art may understand the specific meanings of the foregoing terms in this application according to specific situations.

The term used herein is for the purpose of describing specific embodiments only and is not intended to be limiting of exemplary embodiments. As used herein, the singular forms "a", "an" and "the" are intended to include the plural forms as well, unless the context clearly indicates otherwise. It should be further understood that the terms "include" and/or "comprise" when used in this specification, specify the presence of stated features, integers, steps, and/or operations, but do not preclude the presence or addition of one or more other features, integers, steps, operations, and/or combinations thereof.

This application is further described below with reference to the accompanying drawings and optional embodiments.

Figure 2:
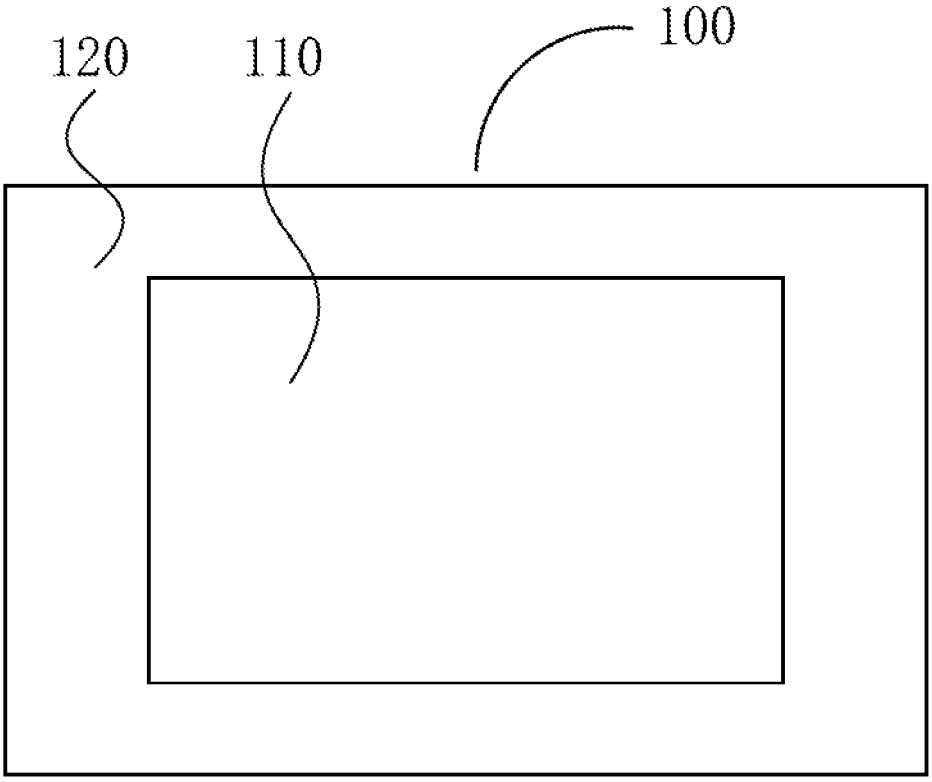
FIG. 2 is a schematic diagram of a display panel according to an embodiment of this application.
Figure 3:
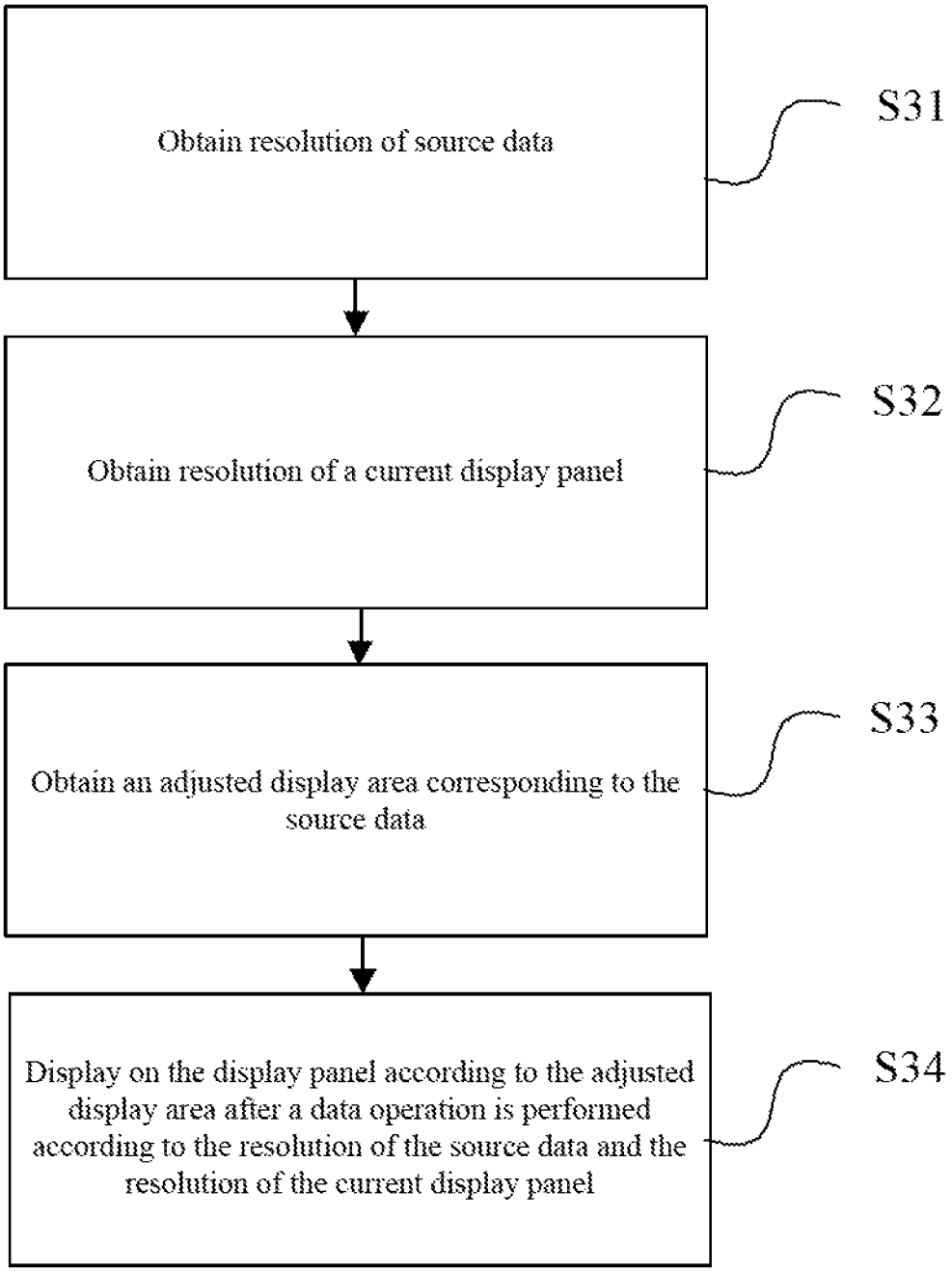
FIG. 3 is a schematic flowchart of a driving method for a display panel according to an embodiment of this application.

As shown in FIG. 2 and FIG. 3, an embodiment of this application discloses a driving method for a display panel 100, including steps of:

S31: obtaining resolution of source data;

S32: obtaining resolution of the current display panel 100;

S33: obtaining an adjusted display area corresponding to the source data;

S34: displaying on the display panel 100 according to the adjusted display area after a data operation is performed according to the resolution of the source data and the resolution of the current display panel 100.

In this solution, when the display panel 100 is driven, resolution of sources may be different for different source data received by the display panel 100, so that definition of pictures displayed by the display panel 100 may be different. In the solution, a size and a location of a display area of the display panel 100 are set for source data having different resolution, an operation is correspondingly adjusted according to the resolution of the source and the resolution of the display panel 100, and a display is performed in a wanted location of the display area and in a wanted size of the display area. Compared with the solution of displaying the source data directly on the display panel 100 according to original resolution, the size of the display area can be adjusted according to a user requirement, then actual resolution of same source data is adjusted accordingly, and during a display, a display effect which is better and closer to the user requirement can be archived.

In one or more embodiments, in the step of obtaining an adjusted display area corresponding to the source data: a size of an actual display area 110 is automatically calculated according to the resolution of the source data and actual resolution of the display panel 100 with a preset corresponding ratio.

In this solution, the source data does not correspond to the resolution of the display panel 100, leading to a rough picture displayed. In this solution, after the source data is obtained, the size of the actual, display area 110 is automatically calculated directly according to the resolution of the source data with the preset corresponding ratio, without a user selection, so that a user operation is simple, convenient use is implemented, and, better experience is achieved.

In one or more embodiments, in the step of obtaining an adjusted display area corresponding to the source data: a display is performed, according to the resolution of the source data and actual resolution of the display panel 100, in a 1:1 manner corresponding to each pixel in the display panel to calculate a size of an actual display area 110.

In this solution, without a user selection, the display is performed, directly according to the actual resolution of the display panel 100, in the 1:1 manner corresponding to each pixel in the display panel 100, where 1:1 means that a source data is displayed corresponding to one RGB pixel used to drive the display panel, for example, if the resolution of display panel is 3840*2160, and the resolution of the source data is 1920*1080, only a 1920*1080 display area in the display panel is driven as an actual effective display area, while other areas may display other pictures or may not work. In this case, a size of the effective display area corresponding to the source data is ¼ of the display panel. Therefore, in this solution, algorithmic processing such as interpolation or compression does not need to be performed on the source data, so that pictures of resolution of original source data are restored, thereby achieving a better effect.

In one or more embodiments, the step of obtaining an adjusted display area corresponding to the source data includes: promoting a user to input adjustment data of an actual display area 110; and setting an adjusted actual display area 110 according to the adjustment data of the actual display area 110 input by the user.

In this, solution, after the source data is obtained, the user is prompted to input data to be adjusted, then an adjustment is performed according to the data input by the user, and an adjusted area range is the display area, so that the user can adjust definition of pictures to be viewed and set a location of the pictures in the display panel 100, and the user can conveniently view according to sizes of the required pictures and locations of viewing areas, which is close to a user requirement.

In one or more embodiments, before the step of prompting a user to input adjustment data, the method further includes: comparing the resolution of the source data and the resolution of the display panel 100; and when the resolution of the display panel 100 is higher than the resolution of the source data, starting the step of prompting a user to input adjustment data; or when the resolution of the display panel 100 is equal to or lower than the resolution of the source data, directly skipping the step of prompting a user to input adjustment data, and using a whole area of the display panel 100 as the actual display area 100 to drive a hill-picture display of the display panel 100.

In this solution, before promoting the user to input the adjustment data, the resolution of the source data and the resolution of the display panel 100 are compared; and when the resolution of the display panel 100 is higher than the resolution of the source data, the user is prompted to perform an adjustment; or when the resolution of the display panel 100 is equal to or lower than the resolution of the source data, the whole area of the display panel 100 is directly used as the actual display area 100 to drive the full-picture display of the display panel 100, which considers a presentation of a display effect with better resolution and user experience.

In one or more embodiments, in the step of obtaining an adjusted display area corresponding to the source data: if the user selects no adjustment, the whole area of the display panel 100 is used as an actual display area 110 to chive a full-picture display of the display panel 100.

In this solution, when the adjusted display area corresponding to the source data is obtained, when the user selects no adjustment, the whole area of the display panel 100 is used as the actual display area 110, to provide the user with different selections and convenient and effective display pictures, which is close to the user requirement.

In one or more embodiments, the adjustment data of the actual display area 110 includes: a size of the actual display area 100; and in the step of obtaining an adjusted display area corresponding to the source data, the input size of the actual display area 110 is directly set to an adjusted size of the actual display area 110. The step of displaying on the display panel 100 according to the adjusted display area after a data operation is performed according to the resolution of the source data and the resolution of the current display panel 100 includes: performing a data operation on the source data according to a size of the display area, correspondingly generating picture data corresponding to each pixel in the actual display area 110 of the display panel 100, driving the display panel 100, and displaying on the display panel 100.

In this solution, the source data is obtained, data of the display area is adjusted according to the size of the actual display area 110, and then adjusted data is input as the size of the actual display area 110. A case of an unclear display picture in a UHD display panel 100 caused by standard definition source is adjusted according to the size of the actual display area 110, to reduce the display picture to avoid visual pressure caused by rough details and blurred images caused by a large size and low definition of a screen.

In one or more embodiments, the adjustment data of the actual display area 110 includes: target resolution of the source; and in the step of obtaining an adjusted display area corresponding to the source data, the corresponding adjusted display area is calculated and generated according to the target resolution of the input source. The step of displaying on the display panel 100 according to the adjusted display area after a data operation is performed according to the resolution of the source data and the resolution of the current display panel 100 includes: performing a data operation on the source data according to the target resolution of the source, calculating and generating a size of the display area, correspondingly generating picture data corresponding to each pixel in the actual display area 110 of the display panel 100, driving the display panel 100, and displaying on the display panel 100.

In this solution, the source data is obtained, the data of the display area is adjusted according to the target resolution of the source, and then adjusted data is input as the size of the actual display area 110. A case of an unclear display picture in a UHD display panel 100 caused by standard definition source is adjusted according to the size of the actual display area 110, to reduce the display picture to avoid visual pressure caused by rough details and binned images caused by a large size and low definition of a screen.

In one or more embodiments, an area outside the adjusted display area of the display panel 100 is a display filling area 120; and in the step of displaying on the display panel 100 according to the adjusted display area after a data operation is performed according to the resolution of the source data and the resolution of the current display panel 100, the source data is displayed in the adjusted display area; and a filling picture is displayed in the filling area 120 the display filling area 120.

In this solution, the area outside the adjusted display area of the display panel 100 is the display filling area 120, when pictures are displayed in the actual display area 110, the filling picture is displayed in the display filling area 120. Optionally, other pictures to be viewed by the user may be displayed in the display filling area 120, to provide the user with more selections and bring better viewing experience to the user.

In one or more embodiments, the adjustment data of the actual display area 110 further includes: a location of the actual display area; and the step of displaying on the display panel 100 according to the adjusted display area after a data operation is performed according to the resolution of the source data and the resolution of the current display panel 100 includes: correspondingly generating, with reference to the location of the actual display area 110, picture data corresponding to each pixel in the actual display area 110 of the display panel 100, driving the display panel 100, and displaying on the display panel 100.

In this solution, the source data is obtained, data of a location of the display area is adjusted, and then adjusted data is input as the location of the actual display area 110, which makes the location of the actual display area 110 meet the user, requirement, enriches diversification of the display panel 100, and brings better watching experience to the user.

In one or more embodiments, the location of the actual display area is a center location of the display panel or an edge location of the display panel. When the display panel is displaying, the location of the actual display area may be set to the center location of the display panel, or the edge location of the display panel, which may be selected according to the user's personal preferences, to enrich diversification of the display panel, and bring better watching experience to the user.

In one or more embodiments, the filling picture is a black picture. After the data operation, clear pictures are displayed in the actual display area 110 of the display panel 100, and black pictures are input in a non-display area, the black pictures around the actual display area 110 can highlight the actually displayed pictures and reduce power consumption, to bring better watching experience to the user. Certainly, filling in other picture data is possible, for example, a plain white picture and the like, which may be displayed according to the user requirement and is suitable for implementation of this embodiment.

In this embodiment, at least two actual display areas corresponding to same or different source data may be arranged, the display panel performs split-screen viewing, in obtained sources, each source may be correspondingly displayed in one area of a display screen, to display a plurality of pictures in one screen, and only one or more pictures may be displayed according to adjusted requirements, so that the definition of the display picture is adjusted, and diversification of display is enriched, and utilization of the display screen is improved.

In one or more embodiments, of this application, referring to FIG. 1, a driving circuit 200 is disclosed, including: a source analysis chip 210 configured to obtain resolution of source data; a panel resolution analysis chip 220, configured to obtain resolution of a current display panel 100; an adjusted display area obtaining chip 230, configured to obtain an adjusted display area corresponding to the source data; and a calculation and display chip 240, configured to: perform a data operation according to the resolution of the source data and the resolution of the current display panel 100, generate actual driving data, and display on the display panel according to the adjusted display area.

In this solution, the source analysis chip 210, the panel resolution analysis chip 220, the adjusted display area obtaining chip 230, and the calculation and display chip 240 are used to distinguish, sort out and calculate the input source signals, and then display on the display panel 100, the standard definition source data may have a clearer display picture on the UHD display panel 100 after being sorted out by the driving circuit 200, so that the user has better viewing experience.

Figure 4:
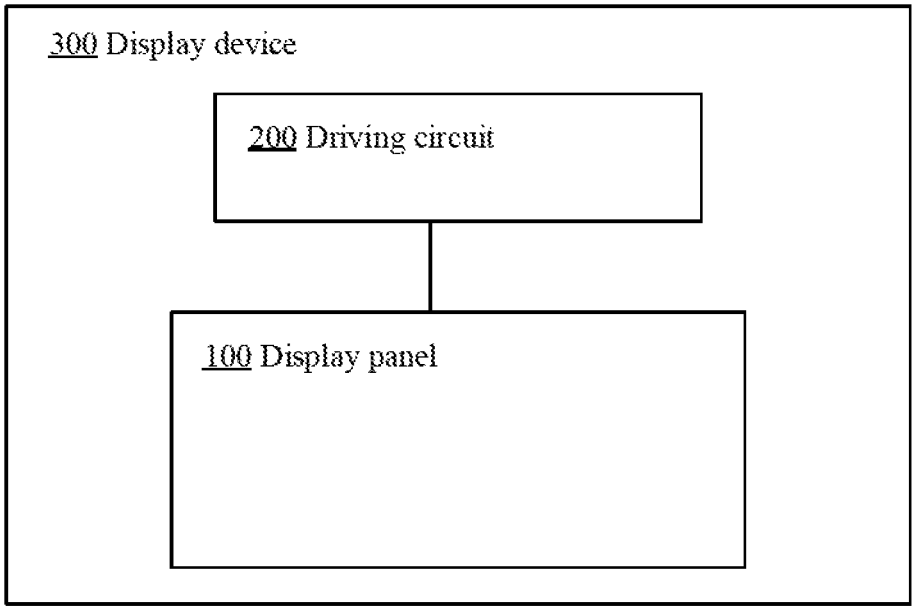
FIG. 4 is a schematic diagram of a display device according to an embodiment of this application.

In one or more embodiments, of this application, referring to FIG. 4, a display device 300 is disclosed, including a display panel 100, and a driving circuit 200 for driving the display panel 100.

It should be noted that, the restrictions of the steps involved in this solution are not determined as restricting the sequence of steps without affecting the implementation of the specific solution, the preceding steps may be executed first, later or even simultaneously, as long as the implementation of this solution may be carried out, should all be considered as falling within the protection scope of this application.

The technical solutions of this application can be widely applied to flat panel displays such as a TFT-LCD and an organic light-emitting diode (OLED) display.

The foregoing contents are detailed descriptions of this application in conjunction with specific optional embodiments, and it should not be considered that the specific implementation of this application is limited to these descriptions. A person of ordinary skill in the art can further make simple deductions or replacements without departing from the concept of this application, and such deductions or replacements should all be considered as falling, within the protection scope of this application.

What is claimed is:

1. A driving method for a display panel, comprising steps of:

obtaining resolution of source data;

obtaining resolution of the current display panel;

obtaining an adjusted display area corresponding to the source data; and displaying on the display panel according to the adjusted display area after a data operation is performed according to the resolution of the source data and the resolution of the current display panel;

wherein an area outside the adjusted display area of the display panel is a display filling area; and in the step of displaying on the display panel according to the adjusted display area after a data operation is performed according to the resolution of the source data and the resolution of the current display panel, the source data is displayed in the adjusted display area; and a filling picture is displayed in the filling area;

wherein the filling picture is a black picture;

wherein at least two actual display areas are arranged on the display panel, and the at least two display areas correspond to same or different source data;

the display panel performs split-screen viewing, in obtained sources, each source may be correspondingly displayed in one area of a display screen, to display a plurality of pictures in one screen, and more pictures may be displayed according to adjusted requirements.

2. The driving method for a display panel according to claim 1, wherein in the step of obtaining an adjusted display area corresponding to the source data:

automatically calculating a size of an actual display area with a preset corresponding ratio according to the resolution of the source data and actual resolution of the display panel.

3. The driving method for a display panel according to claim 1, wherein in the step of obtaining an adjusted display area corresponding to the source data:

displaying, according to the resolution of the source data and actual resolution of the display panel, in a 1:1 manner corresponding to each pixel in the display panel to calculate a size of an actual display area.

4. The driving method for a display panel according to claim 1, wherein the step of obtaining an adjusted display area corresponding to the source data comprises:

prompting a user to input adjustment data of an actual display area; and setting an adjusted actual display area according to the adjustment data of the actual display area input by the user.

5. The driving method for a display panel according to claim 4, wherein before the step of prompting a user to input adjustment data, the method further comprises:

comparing the resolution of the source data and the resolution of the display panel; and when the resolution of the display panel is higher than the resolution of the source data, starting the step of prompting a user to input adjustment data.

6. The driving method for a display panel according to claim 5, wherein before the step of prompting a user to input adjustment data, the method further comprises:

comparing the resolution of the source data and the resolution of the display panel; and when the resolution of the display panel is equal to or lower than the resolution of the source data, directly skipping the step of prompting a user to input adjustment data, and using a whole area of the display panel as the actual display area to drive a full-picture display of the display panel.

7. The driving method for a display panel according to claim 4, wherein the adjustment data of the actual display area comprises: obtaining target resolution of a source; and in the step of obtaining an adjusted display area corresponding to the source data, the adjusted actual display area is calculated and generated according to the target resolution of the input source.

8. The driving method for a display panel according to claim 7, wherein the step of displaying on the display panel according to the adjusted display area after a data operation is performed according to the resolution of the source data and the resolution of the current display panel comprises:

performing a data operation on the source data according to the target resolution of the source, calculating and generating a size of the display area, correspondingly generating picture data corresponding to each pixel in the actual display area of the display panel, driving the display panel, and displaying on the display panel.

9. The driving method for a display panel according to claim 4, wherein the adjustment data of the actual display area comprises: a size of the actual display area; and in the step of obtaining an adjusted display area corresponding to the source data, an input size of the actual display area is directly set to an adjusted size of the actual display area.

10. The driving method for a display panel according to claim 9, wherein the step of displaying on the display panel according to the adjusted display area after a data operation is performed according to the resolution of the source data and the resolution of the current display panel comprises:

performing a data operation on the source data according to a size of the display area, correspondingly generating picture data corresponding to each pixel in the actual display area of the display panel, driving the display panel, and displaying on the display panel.

11. The driving method for a display panel according to claim 4, wherein the adjustment data of the actual display area further comprises: a location of the actual display area; and the step of displaying on the display panel according to the adjusted display area after a data operation is performed according to the resolution of the source data and the resolution of the current display panel comprises:

correspondingly generating, with reference to the location of the actual display area, picture data corresponding to each pixel in the actual display area of the display panel, driving the display panel, and displaying on the display panel.

12. The driving method for a display panel according to claim 11, wherein the location of the actual display area is a center location of the display panel or an edge location of the display panel.

13. The driving method for a display panel according to claim 1, wherein in the step of obtaining an adjusted display area corresponding to the source data:

if the user selects no adjustment, using a whole area of the display panel as an actual display area to drive a full-picture display of the display panel.

14. A driving circuit, comprising:

a source analysis chip, configured to obtain resolution of source data;

a panel resolution analysis chip, configured to obtain resolution of a current display panel;

an adjusted display area obtaining chip, configured to obtain an adjusted display area corresponding to the source data; and a calculation and display chip, configured to: perform a data operation according to the resolution of the source data and the resolution of the current display panel, generate actual driving data, and display on the display panel according to the adjusted display area;

wherein an area outside the adjusted display area of the display panel is a display filling area; and in the step of displaying on the display panel according to the adjusted display area after a data operation is performed according to the resolution of the source data and the resolution of the current display panel, the source data is displayed in the adjusted display area; and a filling picture is displayed in the filling area;

wherein the filling picture is a black picture;

wherein at least two actual display areas are arranged on the display panel, and the at least two display areas correspond to same or different source data;

the display panel performs split-screen viewing, in obtained sources, each source may be correspondingly displayed in one area of a display screen, to display a plurality of pictures in one screen, and more pictures may be displayed according to adjusted requirements.

15. A display device, comprising:

a display panel; and a driving circuit for driving the display panel, the driving circuit comprising:

a source analysis chip, configured to obtain resolution of source data;

a panel resolution analysis chip, configured to obtain resolution of a current display panel;

an adjusted display area obtaining chip, configured to obtain an adjusted display area corresponding to the source data; and a calculation and display chip, configured to: perform a data operation according to the resolution of the source data and the resolution of the current display panel, generate actual driving data, and display on the display panel according to the adjusted display area;

wherein an area outside the adjusted display area of the display panel is a display filling area; and in the step of displaying on the display panel according to the adjusted display area after a data operation is performed according to the resolution of the source data and the resolution of the current display panel, the source data is displayed in the adjusted display area; and a filling picture is displayed in the filling area;

wherein the filling picture is a black picture;

wherein at least two actual display areas are arranged on the display panel, and the at least two display areas correspond to same or different source data;

the display panel performs split-screen viewing, in obtained sources, each source may be correspondingly displayed in one area of a display screen, to display a plurality of pictures in one screen, and more pictures may be displayed according to adjusted requirements.

16. The display device according to claim 15, wherein the display panel is a thin film transistor-liquid crystal display (TFT-LCD) panel.

* * * * *